United States Patent [19]

Beckley

[11] 3,974,616

[45] Aug. 17, 1976

[54] STRUCTURAL COMPONENT FOR FORMING LOAD SUPPORTING FRAMES

[76] Inventor: Maxwell David Beckley, 20 Laurence Ave., Turramurra, New South Wales 2074, Australia

[22] Filed: Dec. 9, 1974

[21] Appl. No.: 531,107

[52] U.S. Cl. ..... 52/738; 52/282; 52/264; 220/4 R; 220/76

[51] Int. Cl.[2] ..... B65D 7/00; E04B 1/00; E04C 3/30

[58] Field of Search ..... 220/4 R, 4 F, 75, 76, 220/83, 84; 52/282, 285, 753 D, 738, 264

[56] References Cited

UNITED STATES PATENTS

| | | | |
|---|---|---|---|
| 2,980,285 | 4/1961 | Parsons | 220/84 |
| 3,126,986 | 3/1964 | Madl, Jr. | 52/282 X |
| 3,477,182 | 11/1969 | Fulton | 220/84 X |
| 3,561,633 | 2/1971 | Morrison et al. | 220/84 |
| 3,677,433 | 7/1972 | Collins | 220/4 R |
| 3,687,325 | 8/1972 | Simons | 220/4 F |

*Primary Examiner*—William Price
*Assistant Examiner*—Steven M. Pollard
*Attorney, Agent, or Firm*—Emory L. Groff, Jr.

[57] ABSTRACT

A structural component for use in constructing containers and load supporting frames in building construction, comprises an extruded member of indefinite length, including at least a pair of outer limbs formed longitudinally at right angles to one another, a first inner limb formed longitudinally integrally on the inside of one of the outer limbs in spaced relationship from the inside of the other outer limb to form a first longitudinally extending channel, and a second limb formed longitudinally integrally on the first inner limb in spaced relationship from the inside of said one outer limb to form a second channel extending longitudinally at right angles to said first channel. The component for load supporting frames includes additional inner and outer limbs to provide an additional channel or channels.

1 Claim, 6 Drawing Figures

STRUCTURAL COMPONENT FOR FORMING LOAD SUPPORTING FRAMES

This invention relates to the production and use of structures such as containers, building construction formwork, interior and exterior panelling and window frames for example and the invention has been devised to provide components for use in such structures which can be factory produced to meet specific usage or site requirements and which can be readily assembled for use and disassembled for transport or stowage.

The object of the invention is to provide a structural component which is so designed that it is itself capable of being readily produced and fabricated to form load supporting frames and to perform numerous functions as a frame member, and which can be assembled with other components to produce various types of containers, building construction formwork and the like.

For the sake of simplicity, the structural component will be described as an extruded aluminium member but it is not restricted to this. It can be formed of other metals or from suitable plastics material and can be fabricated or rolled.

According to the invention, the structural component comprises an extruded member of indefinite length comprising a pair of outer limbs formed longitudinally at right-angles to one another, a first inner limb formed longitudinally integrally on the inside of one of the outer limbs in spaced relationship from the inside of the other outer limb to form a first longitudinally extending channel, and a second limb formed longitudinally integrally on the first inner limb in spaced relationship from the inside of said one outer limb to form a second channel extending longitudinally at right angles to said first channel.

The invention will be described with reference to the accompanying drawings, wherein.

Figure 1:
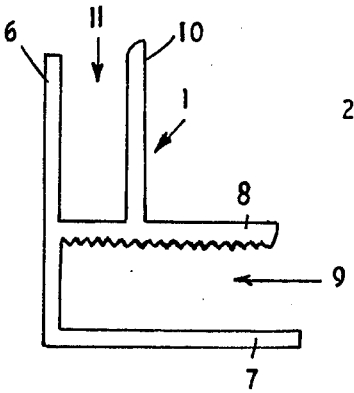
FIG. 1 is an end view of one form of the structural component.
Figure 2:
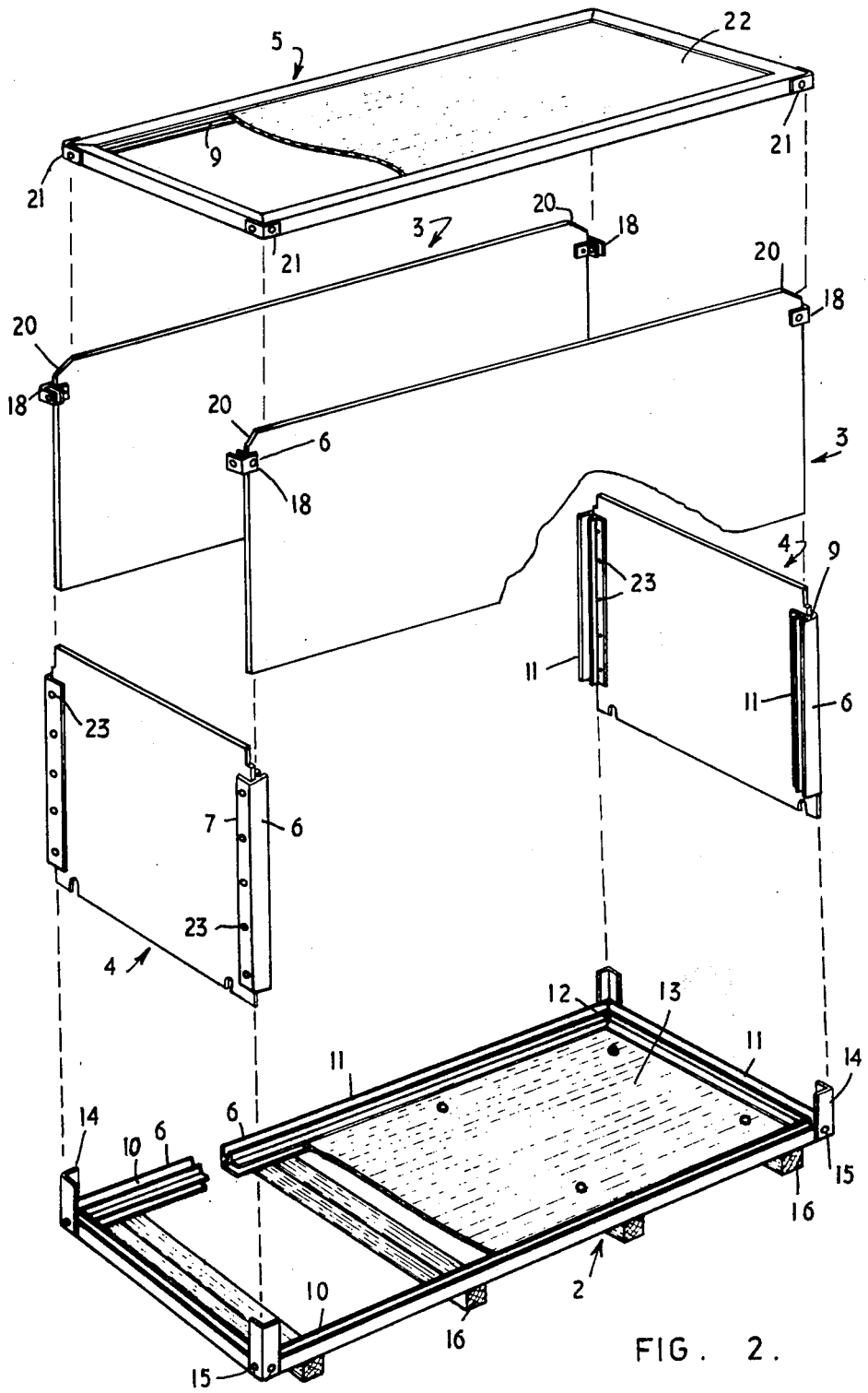
FIG. 2 is an exploded perspective view of a form of container assembled from lengths of the component of FIG. 1.

The structural component 1, FIG. 1, forms a frame for the bottom 2 of a container, FIG. 2, the corner uprights for the sides 3 and ends 4 thereof, and a frame for the top or lid 5. In the illustrated embodiment, it includes a pair of outer limbs 6, 7 formed longitudinally at right angles to one another. A first inner limb 8 is formed integrally longitudinally on the inside of the limb 6 in parallel spaced relationship from the inside of limb 7 and forms a first longitudinally extending channel 9. A second inner limb 10 is formed integrally longitudinally on the first inner limb 8 in parallel spaced relationship from the inside of outer limb 6 to form a second longitudinally extending channel 11 located at right angles to the channel 9.

The structural component as illustrated in FIG. 1 may have dimensional variations to suit particular end use requirements. As seen in FIG. 1, limb 10 projects outwardly beyond limb 6 and limb 7 projects outwardly beyond limb 8. Channel 9 is wider than channel 11 and may have a gripping surface formed as the inner surface of limb 8. Also, radiussed edges are formed longitudinally, continuously on limbs 8 and 10 and at the junction of limbs 6 and 7. This form of the structural component is particularly suitable for use in forming the container illustrated in FIG. 2, for reasons to be explained.

Thus, as shown in the illustrated embodiment, the bottom 2 of the container includes a frame comprising four lengths of component 1 mitred as indicated at 12 at the corners, with the channels 11 facing upwardly. A bottom panel 13 of suitable material such as metal, plywood or hardboard for example, is supported in the aligned channels 9 of the frame, the components 1 of which are secured at the corners by vertically extending bottom corner caps 14 rivetted to the said components 1, as indicated at 15. The bottom 2 as illustrated is reinforced by bearers 16.

The corner uprights for the container are also four lengths of component 1 which support the sides 3 of the container in the channels 11 thereof and the ends 4 of the container 1 in the channels 9 thereof. It will be seen that the bottom edges of the sides 3 and ends 4 are received and supported in the channels 11 of the components 1 forming the frame of the bottom 2 of the container. The corner uprights do not extend for the full height of the sides 3 and ends 4. They are length dimensioned to rest within the bottom corner caps 14 at their lower ends. Short lengths 18 of the components 1 are fixed to the sides 3 adjacent the upper ends of said sides 3, and they rest upon the upper ends of the corner uprights. Also the top corners of the sides 3 may be cut away as at 20 to facilitate the fitting of the top 5 thereon.

The top 5 is of somewhat similar construction to the bottom 2. The four frame components 1 thereof are mitred and secured at the corners by top corner caps 24 and the top panel 22 is not reinforced. The channels 11 of said components 1 face downwardly, to receive the sides 3 and ends 4.

In the embodiment illustrated in FIG. 1, the width of limb 10 of channel 11, being wider than limb 6 thereof, facilitates fitting of panels in channels 11 and also prevents water which enters over limbs 6 into channel 11 from outside, from passing under the panels and over said limbs 10. Also, this arrangement rigidifies an assembled container and prevents tilting of the panels of the container in the channels when another container or other heavy load is placed thereon. The wide limb 10 being on the inside of the assembled container engages the panels if there is any tendency for the assembled container to tilt, and thus prevents any tendency of the horizontal structural components to tilt. Also as each panel is movable in its slots in the plane of the slots, this helps to absorb any tendency of the assembled container to tilt.

Figure 3:
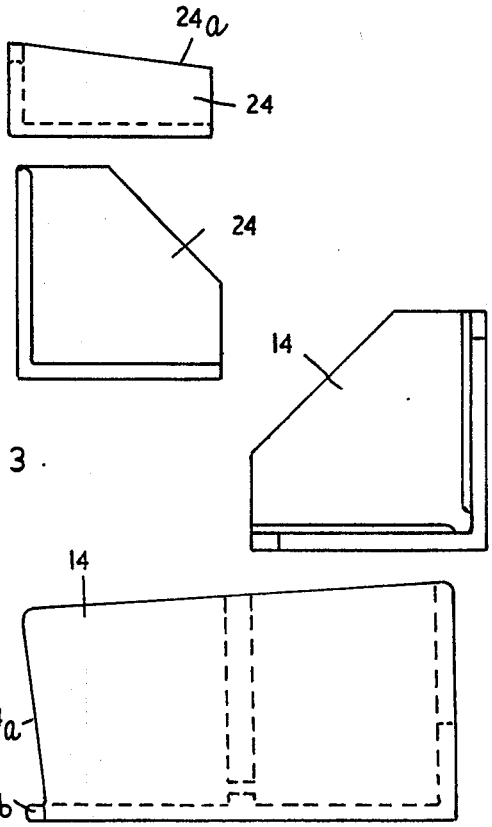
FIG. 3 shows elevational views of corner caps which may be used on the container of FIG. 2

The construction of a container such as the above described embodiment, may be varied to suit particular requirements. The type and thickness of the panels forming the top, bottom, sides and ends are arranged to suit, as are the dimensions of the channels 9 – 11 and wall thickness of the limbs 6, 7, 8 and 10 of the structural component 1. The described embodiment, for example, using plywood panels ¾ inch thick and with a suitable wall thickness for the limbs of component 1, and with the channels thereof dimensioned to receive the mentioned panels, can provide a container for shipboard or other general usage of any suitable dimensions. Such containers can be factory assembled or assembled on site and can also be disassembled when required for transport and stowage. The corner caps 24 and 14 support any top loads on the loose side and end panels contained within, during return shipment in the knocked-down condition, thereby preventing damage to such loose components. Also, referring to FIG. 3, the corner caps 24 and 14 have complementary mating faces 24*a* and 14*a* and the caps 14 have a supporting lip 14*b*. In the knocked-down condition of containers, the corner caps 24 nest on the juxtaposed corner caps 14 with the faces 24*a* and 14*a* in mating engagement and with the caps 24 supported on the supporting lips 14*b*.

Various methods of fixing the components 1 to the panels can be adopted, such as those already described, or by indenting the outer wall 6 or 7, or the inner wall 8 or 10 of component 1, at regular intervals into the panels. Also variations in means for locking the panels together at the corners may be adopted, in addition to that described for the illustrated embodiment, which incorporates the corner caps 14, or corner caps 24, FIG. 3., the corner uprights formed from lengths of the component 1, and the short lengths 18 of said components 1. For example, a spindle and key arrangement, projecting through the corner uprights and through a slot in one of the corner uprights, provides a 90° rotational arrangement for turning the key to a locked, or unlocked and released position, respectively.

Figure 4:
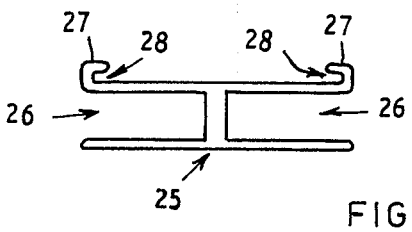
FIG. 4 is an end view of a "spreader" member which may be used for the container of FIG. 2

An extruded section 25, FIG. 4, may be used as an intermediate member — "spreader" — in a container construction to medially rigidify the panels of large containers. The section 25 includes parallel, longitudinal channels 26 which receive and support the container panels. It also has two of its opposite edges inwardly flanged as at 27 to provide longitudinal, opposed channels 28 which are adapted to support a tension bar (not shown) or act as tracks for rollers or the like adapted to support a false floor for the container.

Figure 5:
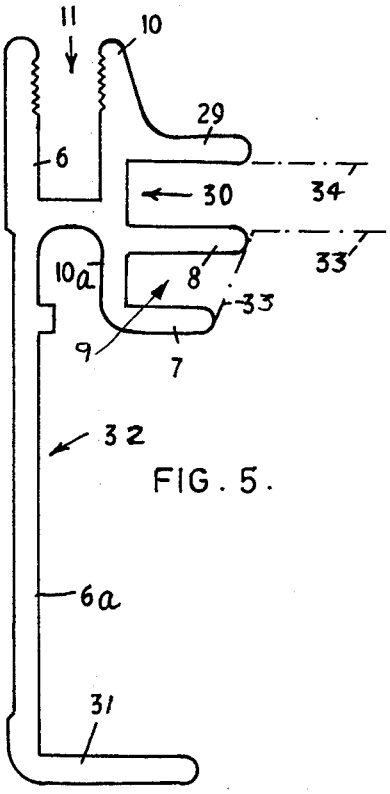
FIG. 5 is a modified form of the structural component of FIG. 1
Figure 6:
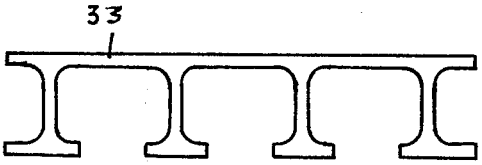
FIG. 6 is a form of a floor supporting section which may be used in conjunction with the component of FIG. 5.

As a modification, the structural member may be used as a coaming rail for vehicle bodies, see FIG. 5. In this form of the invention, the member 1 has the second inner limb 10 extending downwardly as at 10*a* and the first inner limb 8 and the other outer limb 7 formed longitudinally on this extension 10*a* to provide the first channel 9. Also, the one outer limb 6 projects downwardly to provide the extended outer limb 6*a* and is flanged at its distal end inwardly longitudinally as at 31, the flange 31 being parallel with limb 7 and forming a third channel 32 therewith. Above the limb 8 an additional parallel limb 29 is formed to provide a fourth channel 30. The limbs 7 and 29 engage transverse members affixed to the longitudinal chassis members of a vehicle. A floor supporting member indicated at 33, formed for example from truncated V section, corrugated metal sheet, FIG. 5, or as an extruded section, FIG. 6 is supported on the chassis members. A vehicle floor indicated at 34 is supported on the member 33 and the limbs 29 and 10 form the internal rail of the floor 34. The channel 11 is sealed by a dust cover (not shown) pressed therein and for this purpose, longitudinal V serrations are preferably formed on the limbs 6 and 10 within channel 11, to grip and retain the dust cover.

I claim:

1. A structural component for the construction and erection of load supporting frames, said structural component comprising an extruded member of indefinite length comprising a pair of outer limbs formed longitudinally at right angles to one another, a first inner limb formed longitudinally integrally on the inside of one of the outer limbs in spaced relationship from the inside of the other outer limb to form therewith a first longitudinally extending channel, and a second inner limb formed longitudinally integrally on the first inner limb in spaced relationship from the inside of said one outer limb to form therewith a second longitudinally extending channel located at right angles to said first channel, a selected limb of either of the pairs of limbs forming the respective channels projecting outwardly beyond the other limb of said pair, said one outer limb projecting in width beyond said other outer limb to provide an extended outer limb (6*a*) having a flange at its distal end, said flange extending longitudinally inwardly to form a third channel with said other outer limb and an additional limb formed longitudinally on said second inner limb in spaced relationship from said first inner limb to form a fourth channel therewith.

* * * * *